US005587630A

United States Patent [19]

Dooley

[11] Patent Number: 5,587,630

[45] Date of Patent: Dec. 24, 1996

[54] CONTINUOUS PLASMA IGNITION SYSTEM

[75] Inventor: Kevin A. Dooley, Georgetown, Canada

[73] Assignee: Pratt & Whitney Canada Inc., Longueuil, Canada

[21] Appl. No.: 144,080

[22] Filed: Oct. 28, 1993

[51] Int. Cl.[6] ..... H05B 37/02

[52] U.S. Cl. ..... 315/209 T; 315/209 CD; 315/209 M; 315/209 SC

[58] Field of Search ..... 315/209 CD, 209 T, 315/209 M, 209 SC

[56] References Cited

U.S. PATENT DOCUMENTS

| | | | |
|---|---|---|---|
| 3,921,605 | 11/1975 | Wyczalek | 123/143 |
| 4,525,140 | 6/1985 | Larigaldie et al. | 431/258 |
| 4,695,771 | 9/1987 | Hallay | 315/209 CD |
| 4,926,087 | 5/1990 | Kler et al. | 313/131 |
| 4,983,886 | 1/1991 | Balland | 315/209 |
| 4,996,967 | 3/1991 | Rosswurm et al. | 123/598 |
| 5,013,977 | 5/1991 | Droho | 315/209 CD |
| 5,065,073 | 11/1991 | Frus | 315/209 |
| 5,076,223 | 12/1991 | Harden et al. | 123/143 |
| 5,245,252 | 9/1993 | Frus et al. | 315/209 |

OTHER PUBLICATIONS

J. R. Asik, P. Piatkowski, M. J. Foucher, W. G. Rado, "Design of a Plasma Jet Ignition System for Automotive Application", 1978 Society of Automotive Engineers, Inc., pp. 1516–1530.

*Primary Examiner*—Frank Gonzalez
*Assistant Examiner*—Reginald A. Ratliff
*Attorney, Agent, or Firm*—Dominic Chiantera; Jeffrey W. Astle

[57] ABSTRACT

A continuous plasma ignition system includes an exciter 12, an ignitor plug 16 and a cable 18 which connects the excitor 12 to the ignitor plug 16. The ignition system operates at the resonant frequency value $f_r$ of the circuit formed by the exciter, ignitor plug and the cable, such that, a continuously plasma 23 of ionized air is provided across the ignitor gap 22.

25 Claims, 8 Drawing Sheets

CONTINUOUS PLASMA IGNITION SYSTEM

TECHNICAL FIELD

This invention relates to an ignition system and more particularly to a continuous plasma ignition system for a gas turbine engine.

BACKGROUND ART

An ignition system for a gas turbine engine typically includes an electrical power source, two ignitor plugs, separate exciters for each ignitor plug and the associated cables and wire harnesses. Each exciter converts either an AC or DC low voltage value to a high voltage value for delivery to the exciter's associated ignitor plug. Dual ignitors are used in an aircraft gas turbine engine to ensure the failure of a single ignitor will not result in loss of the ability to light or re-light an engine.

Ignition systems are not only used for engine starting, but also for ignition stand-by protection to relight the engine in the event of an in-flight flameout while operating under potentially unstable flight conditions such as icing, air turbulence, takeoffs, low approaches, go-arounds and landings. A small change in airflow at the compressor inlet, or at the entrance to the aircraft inlet duct, may cause a condition for which the fuel control can not immediately compensate, and a flameout results. Such a condition may occur by flying in turbulent air, or perhaps, by bird ingestion or ingestion of ice broken off the engine inlet. If a flameout does occur while one or more of the exciters are operating, the engine should relight automatically as soon as fuel control compensation takes place, and the abnormal inlet condition corrects itself. Ideally, the time from flameout to automatic relight is so fast the brief flameout should be transparent to the pilot.

Although aircraft gas turbine engines can be ignited quite easily under ideal situations, aircraft gas turbine engines typically operate at high altitudes (e.g., 36,000 feet) where conditions for an engine relight in the event of a flameout are less than ideal. The low temperatures encountered at high altitude cause a decrease in fuel volatility which contributes to the difficulty of re-igniting the fuel. While it may be advantageous to operate the ignitors continuously from a safety point of view for an automatic relight, continuous operation significantly reduces the ignitor's operational life due to the high pulsed voltage operation of the ignitor.

A well known type of pulsed voltage ignition system is the high energy capacitor ignition system which employs a DC capacitive discharge arrangement to apply the high pulsed instantaneous voltage to the ignitor. For an aircraft gas turbine engine, the exciter typically uses a DC-to-DC converter circuit which converts the conventional 28 VDC aircraft power bus signal to a high voltage which is used to charge a storage capacitor. The storage capacitor is discharged into the ignitor plug which results in a very short duration (typically less than 100 microseconds) high temperature (e.g., approx. 10,000° C.) plasma of ionized air across the ignitor gap. The high temperature plasma of ionized air ignites the fuel in the vicinity of the ignitor gap to initiate combustion. Due to the rapid temperature increase of the pulsed plasma, a high pressure shock wave occurs which results in the local fatigue of the ignitor and erosion of ignitor components (e.g., the electrodes and the insulator material).

DISCLOSURE OF THE INVENTION

An object of the present invention is to provide a gas turbine ignitor system which is less susceptible to ignitor electrode erosion and insulator erosion, thus extending the operational life of the ignitor.

Another object of the present invention is to provide an ignition system which allows lower temperature engine lights and relights thus extending the operational life of hot engine section components.

Yet another object of the present invention is to provide a faster ignition which reduces the build up of unburned fuel in the gas turbine combustor prior to ignition.

According to the present invention, a continuous plasma gas turbine ignition system includes an exciter which resonantly drives an ignitor plug and cable that connects the excitor to the ignitor plug to create a plasma of ionized gas across the ignitor gap.

Once the plasma has been created, the ignition system becomes highly damped allowing the ignitor to be driven at frequencies other than the resonant frequency to continuously maintain the plasma across the ignitor gap.

An advantage of the present invention is the continuous gaseous plasma arc across the ignitor gap eliminates the repetitive shocks associated with pulsed plasma arcs provided by conventional capacitive discharge techniques. This allows the ignitor system of the present invention to provide a continuous source of heat at the ignitor gap which is lower in temperature, but provides significantly greater heat output (i.e., watt seconds) due to the continuous nature of the plasma across the ignitor gap. The increased heat output facilitates faster ignition over a wider range of non-ideal ignition conditions.

The present invention delivers at least ninety times the heating power to the tip of the ignitor than existing systems of similar size and weight, while significantly reducing the magnitude of the current which destructively flows across the ignitor gap.

These and other objects, features and advantages of the present invention will become more apparent in light of the following detailed description of a preferred embodiment thereof, as illustrated in the accompanying drawings.

BEST MODE FOR CARRYING OUT THE PRESENT INVENTION

Figure 1:
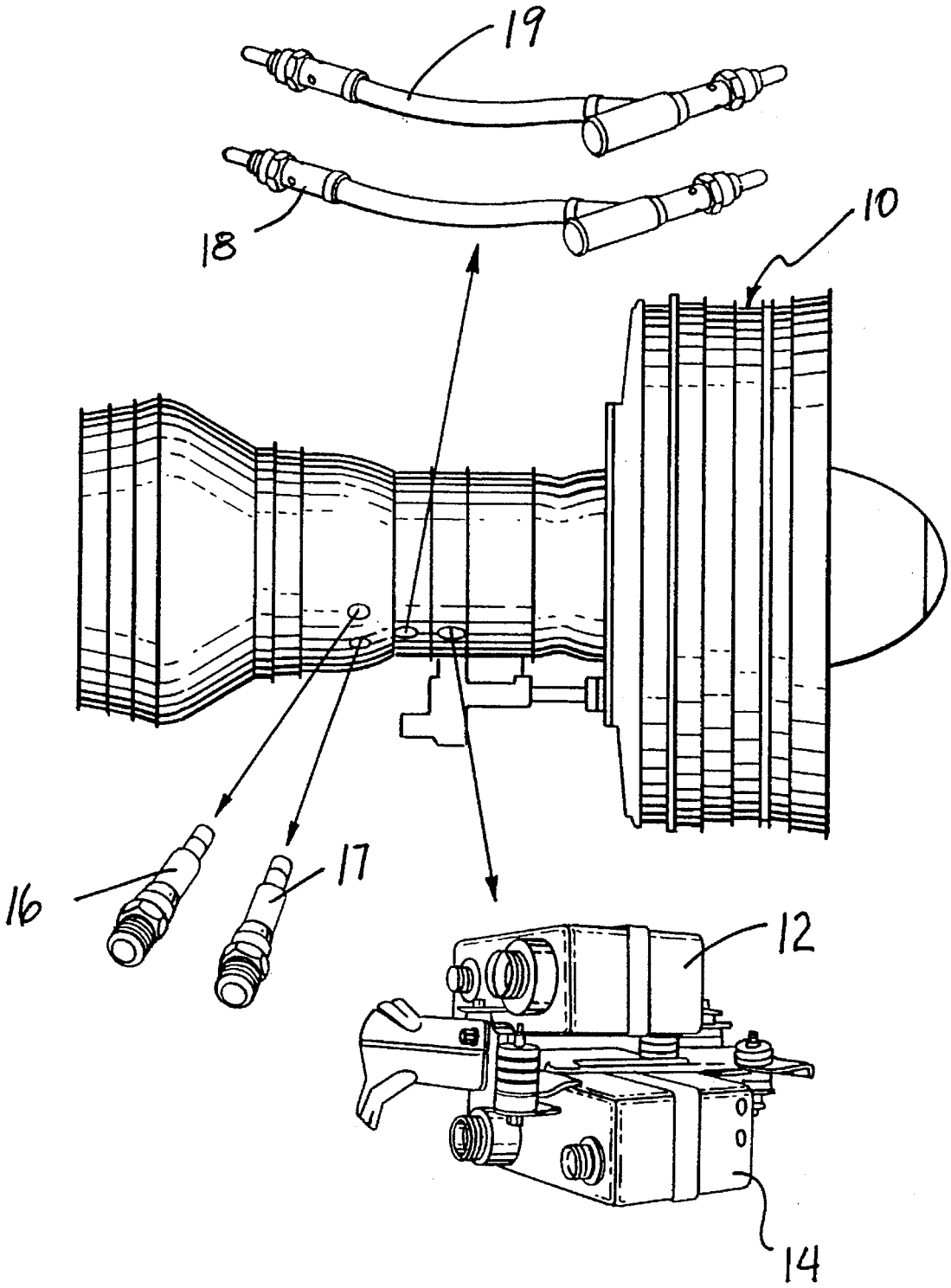
FIG. 1 is an illustration of a gas turbine engine and the constituent parts of a dual ignitor ignition system for the engine.
Figure 2:
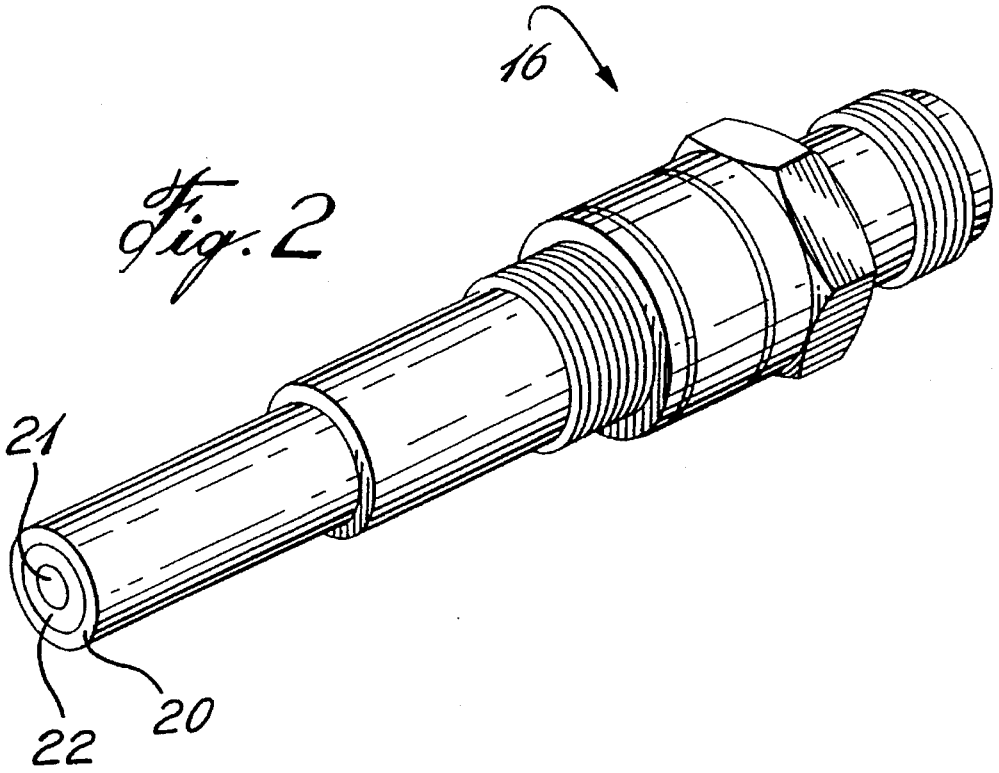
FIG. 2 illustrates the ignitor 16.
Figure 3:
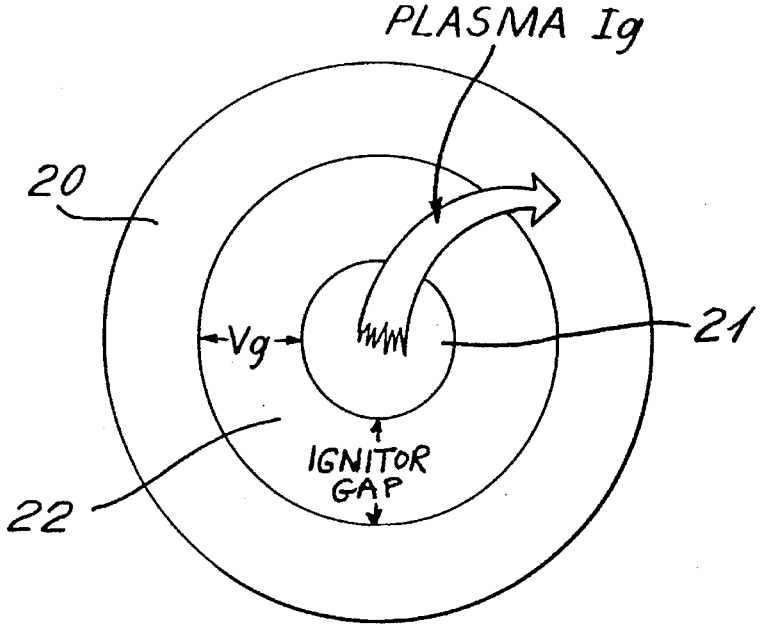
FIG. 3 illustrates the tip of the ignitor of FIGS. 1 and 2 and the plasma formed across the ignitor gap.

Referring to FIG. 1, a gas turbine engine 10 (e.g., an aircraft gas turbine engine) includes a dual ignition system having dual ignition exciters 12, 14, dual air gap ignitors 16, 17 and electrically shielded cables 18, 19 (e.g., coaxial) to interface the exciters 12, 14 and the ignitors 16, 17. According to the present invention, the exciters 12, 14 drive the ignitors 16, 17 such that a continuous plasma of ionized air is created and maintained across the air gap of each ignitor to ignite fuel within the combustion chamber of the engine 10. FIG. 2 illustrates a view of the ignitor 16, and more particularly the ignitor tip which includes an outer electrode 20 and an inner electrode 21 separated by an insulator 22. FIG. 3 is a graphical illustration of the ignitor tip and plasma 23 which is formed between the electrodes 20, 21 and through which ignitor gap current $I_g$ flows between the electrodes.

Figure 4:
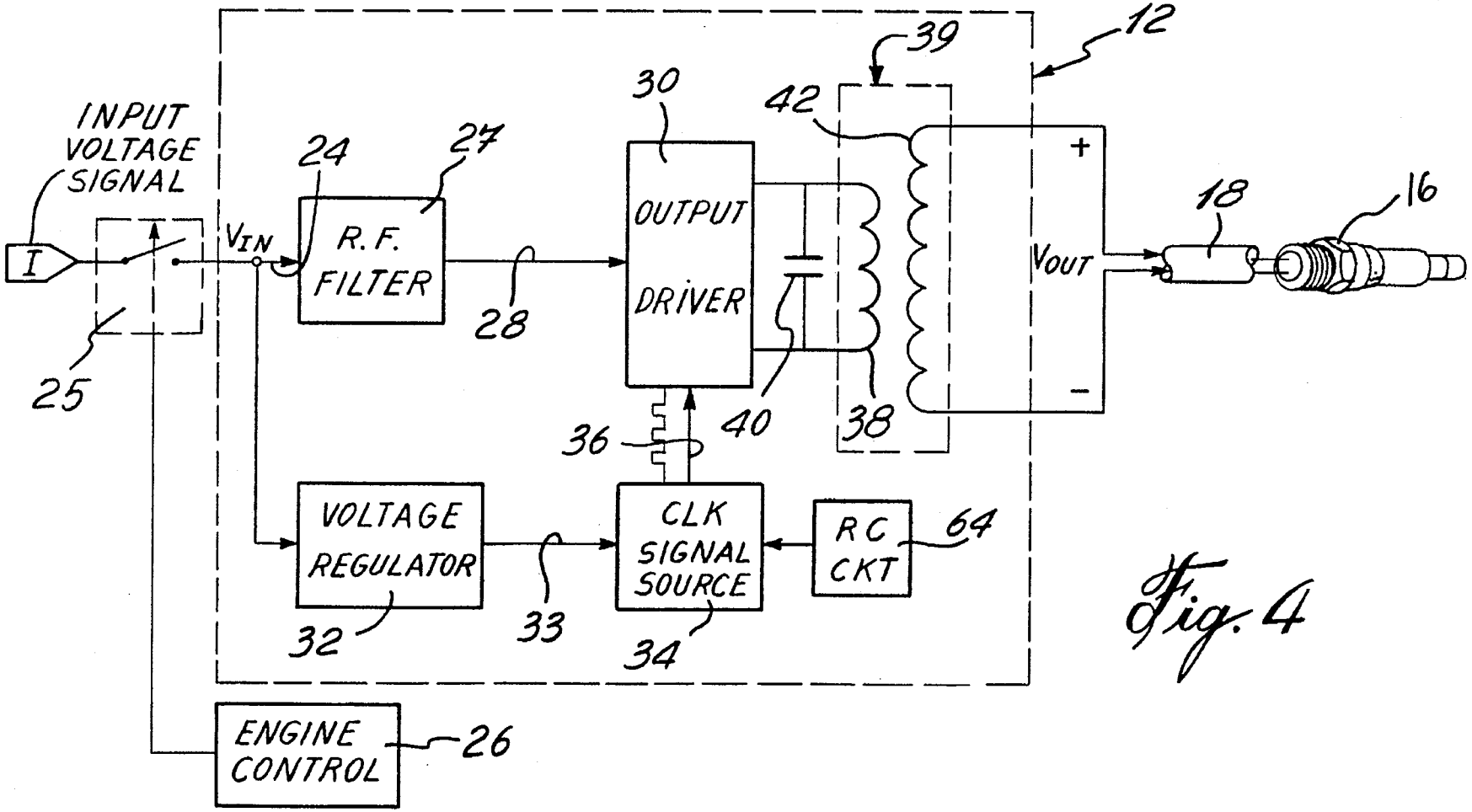
FIG. 4 is a functional block diagram of a continuous plasma ignition system according to the present invention.

FIG. 4 illustrates a top level functional block diagram of a continuous plasma ignition system including the exciter 12, cable 18 and ignitor 16. The operation of the other ignitor system comprising exciter 14, cable 19 and ignitor 18 is identical. Power to the exciter 12 is controlled by a switch 25 operated under the command of an engine control 26. When the engine control 26 commands the ignitor on, the switch 25 closes providing an input voltage signal (e.g., 28 vdc) on a line 24. When the switch 25 is in the open position the exciter is off. A radio-frequency (RF) low pass filter 26 attenuates electrical noise coupled onto the electrical bus line 24, and provides a filtered direct current (DC) input signal on a line 28 to an output driver 30. The input voltage signal on the line 24 is also input to a voltage regulator 32 which provides a regulated voltage signal on a line 33 to a clock signal source 34. The clock signal source 34 in turn provides a regulated periodic voltage signal on a line 36 for switching the output driver 30 on and off.

The output driver 30 drives a primary winding 38 of a transformer 39 located electrically in parallel with a capacitor 40 selected to resonate with the primary winding 38 and produce a primary kick back voltage value safe for the output driver 30. The transformer 39 is preferably a non-saturatable air core type having relatively low inductance. As an example, the transformer may be a step up transformer having a turns ration of 1:200. The primary winding 38 may use a #14 gauge wire while the secondary winding 42 uses a #30 gauge wire. Each winding may be wound on separate plastic bobbins having a core diameter of approximately 1.4 inches (0.55 centimeters) and a rim diameter of approximately 3 inches (1.18 centimeters) with a bobbin length of about 0.25 inches (0.10 centimeters). After winding the wire onto the bobbins, the spools can be bonded together and encapsulated in a thermally conductive epoxy to form the transformer 39. In general, the transformer 39 is similar in construction to the well known flyback transformer used in televisions.

In a well known manner, the voltage across the primary winding 38 is coupled to a secondary winding 42 of the transformer 39 and routed to the ignitor 16 by the shielded cable 18. For an explanation of how the continuous plasma is created and maintained by the circuitry of the present invention, a more detailed embodiment of the exciter 12 will be set forth below.

Figure 5:
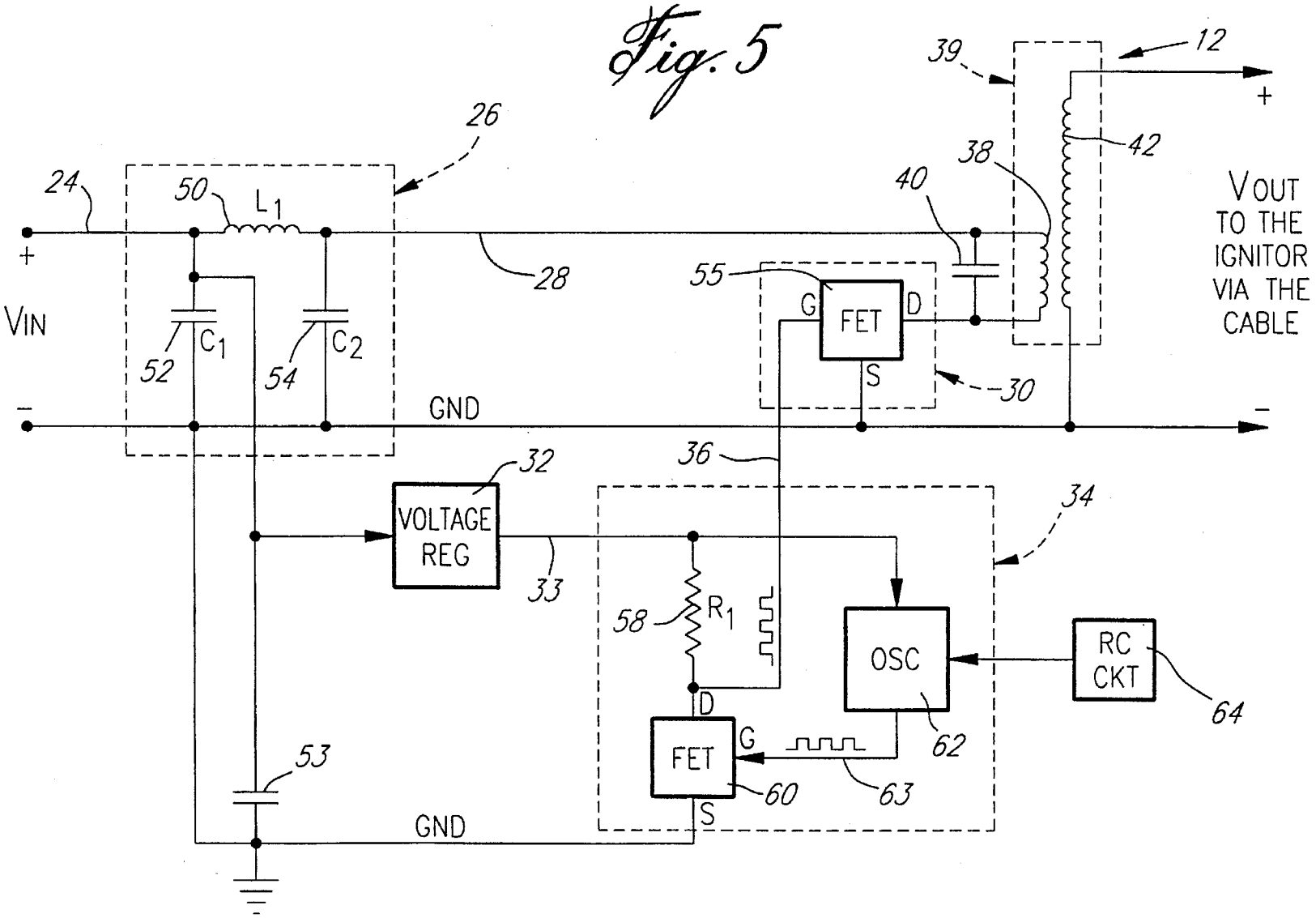
FIG. 5 is a detailed circuit block diagram of the exciter which drives the ignitor.

FIG. 5 illustrates a detailed circuit block diagram of the exciter 12. The RF filter 26 includes an inductor $L_1$ 50, and capacitors $C_1$ and $C_2$ 52, 54 which cooperate to attenuate RF noise created by the switching of transformer 39. The filter 26 should have a break frequency of about several KHz (e.g., 3 KHz). Ideally, a filter having a break frequency in the hundreds of Hz (e.g., 300 Hz) would be used if the physical size of the inductor 50 and capacitors 52, 54 necessary to implement such a filter were not so prohibitively large. Size and weight are sensitive parameters in an aircraft gas turbine engine.

The RF filter 26 provides the filtered DC voltage signal on the line 28 to the drain input of a power switching field-effect-transistor (FET) 55 via the primary winding 38. The FET 55 is switched on and off by the signal on the line 36 to provide an AC voltage signal across the primary winding.

The voltage regulator 32 can be a well known three terminal voltage regulator such as a 12 VDC through terminal voltage regulator model number LM7811AC available from National Semiconductor. In general, any circuit capable of providing a regulated voltage on the line 33 is acceptable.

The clock signal source 34 includes a resistor $R_1$ 58 and a FET 60 which is driven by an oscillator 62. When the output from the oscillator 62 on a line 63 is high (e.g., 5 VDC) the FET 60 allows current to flow through resistor $R_1$ 58 placing approximately 0 vdc on the line 36. When the signal on the line 63 is low the FET 60 is off and the voltage on the line 36 is approximately equal to the regulated voltage value on the line 33. Rather than driving the power switching FET 55 directly from the oscillator 62, FET 60 is used as the driver since the oscillator 62 may not have sufficient power due to the inherent parasitic capacitance across the gate and source of the power switching FET 55. The oscillator 62 is preferably a single integrated circuit (IC) such as IC model number SE555 available from Signetics. The frequency of the signal on the line 63 is controlled in a well known manner by the time constant of an RC circuit 64.

Figure 6:
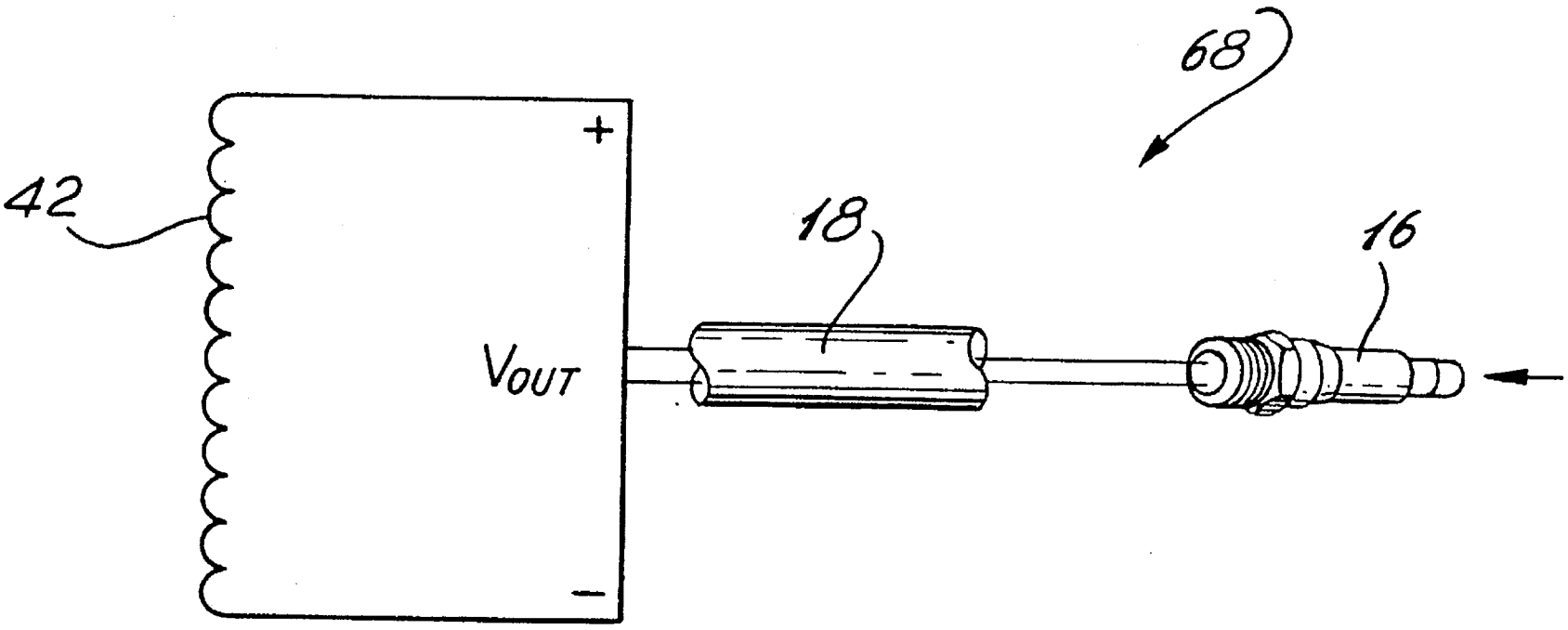
FIG. 6 is an illustration of the secondary resonant tank circuit of FIG. 5.

To achieve the continuous plasma according to the present invention, the frequency of the periodic waveform on the line 63 is set to operate at the resonant frequency value $f_r$ of the transformer/cable/ignitor circuit. That is, the net inductance of the secondary winding 42 in conjunction with the distributed capacitance of the shielded cable 18 and the ignitor 16 form a secondary resonant tank circuit having a resonant frequency value $f_r$. The resonant frequency $f_r$ of the tank circuit is the value at which the oscillator 62 is set to operate at by properly selecting the time constant for the RC circuit 64. FIG. 6 illustrates the components of FIG. 5 which constitute the secondary resonant tank circuit 68.

Having observed the details of the exciter circuit 12, attention may now be given to reviewing several data plots from tests performed using component values from Table 1 for the components in FIG. 4.

TABLE I

| COMPONENT | ELEMENT # | VALUE | COMMENT |
|---|---|---|---|
| $C_1$ | 52 | 100 μF | 63V, Low E.S.R. |
| $C_2$ | 54 | 2800 μF | 50V, Low, E.S.R. |
| $C_3$ | 53 | 2.2 μF | 50V, Low Solid Tantalum |
| $C_P$ | 40 | 0.43 μF | 500V, Polypropylene |

TABLE I-continued

| COMPONENT | ELEMENT # | VALUE | COMMENT |
|---|---|---|---|
| $C_D$ | See Note 1 | ≈ 259 pF | Represents the distributed capacitance of the cable, the transformer secondary winding and the ignitor. |
| $R_1$ | 58 | 300 ohms | 0.5 watts |
| $L_1$ | 50 | 50 μH | 10 amp DC high frequency choke |
| $Q_1$ | 55 | — | Model number IRFK4H350, International Rectifier HEXFET |
| $Q_2$ | 60 | — | Model Number VN10KM, Siliconics |
| $U_1$ | 32 | — | Model Number LM78112AC, National Semiconductor |
| $U_2$ | 62 | — | Model Number SE555, Signetics |
| Ignitor | 16 | — | Air gap set to approximately 2.5 mm. |

NOTE 1: $C_D$ is not a discrete devicer rather $C_D$ represents the distributed capacitance of the cable 18, the transformer secondary winding 42 and the ignitor 16.

Figures 7A, 7B:
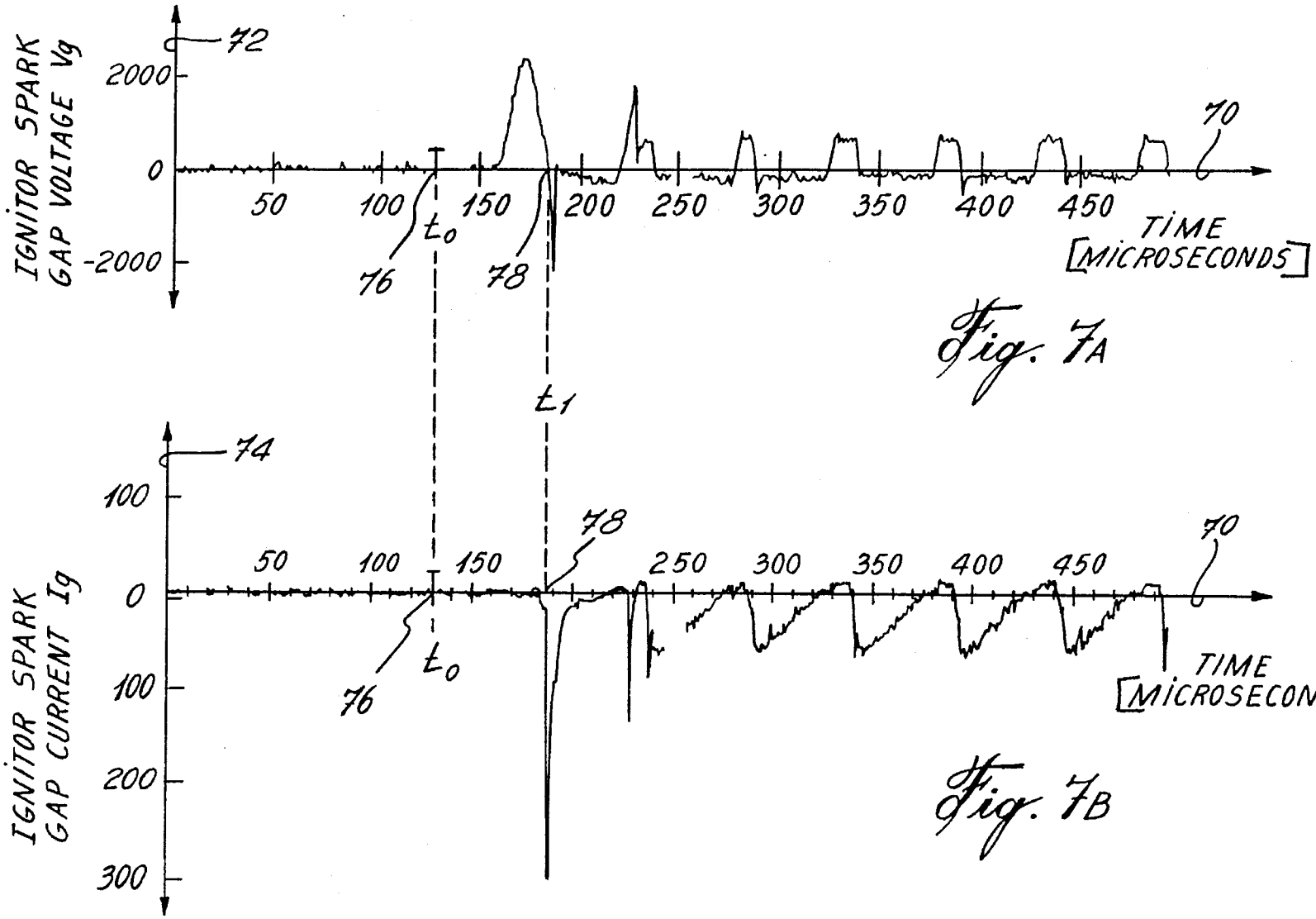
FIGS. 7A and 7B illustrate actual test data plots of voltage $V_g$ across the ignitor gap versus time, and current $I_g$ across the ignitor gap versus time, when power is initially applied to the ignitor.

Referring to FIGS. 7A and 7B, time is plotted along horizontal axes 70, while ignitor voltage $V_g$ is plotted along a vertical axis 72 in FIG. 7A, and electrical current $I_g$ across the ignitor gap is plotted along vertical axis 74 in FIG. 7B. At $t_0$ 76, voltage is first applied to the exciter 12 by closing the switch 25 (FIG. 2) to initiate exciting the undamped resonant tank circuit 68 (FIG. 5) at its resonant frequency value $f_r$. The resonant frequency value $f_r$ for the ignition system defined by the component values of Table 1 was approximately 20 KHz for a transformer having about 16 μH of primary inductance and 250 mH of secondary inductance. In general, the resonant frequency range will be about 10–30 KHz. During the time period from $t_0$ 76 to $t_1$ 78 energy builds within the secondary tank circuit 68 until air between the outer and inner electrodes 20, 21 (FIG. 3) ionizes to form plasma 23 (FIG. 3) at time $t_1$ 78. Subsequent to $t_1$, the plasma 23 has formed across the ignitor gap and a continuous (i.e., non-zero) flow of current $I_g$ is established across the gap through the plasma. The secondary tank circuit 68 is now fully damped and transformer behaves as a simple 200:1 current transformer which is driven at the resonant frequency value $f_r$ to maintain the continuous plasma of the present invention. Attention is drawn to the fact that since the secondary tank circuit 68 is now fully damped, plasma can be maintained across the ignitor gap by driving the transformer at a frequency value other than the resonant frequency $f_r$.

Figure 8A:
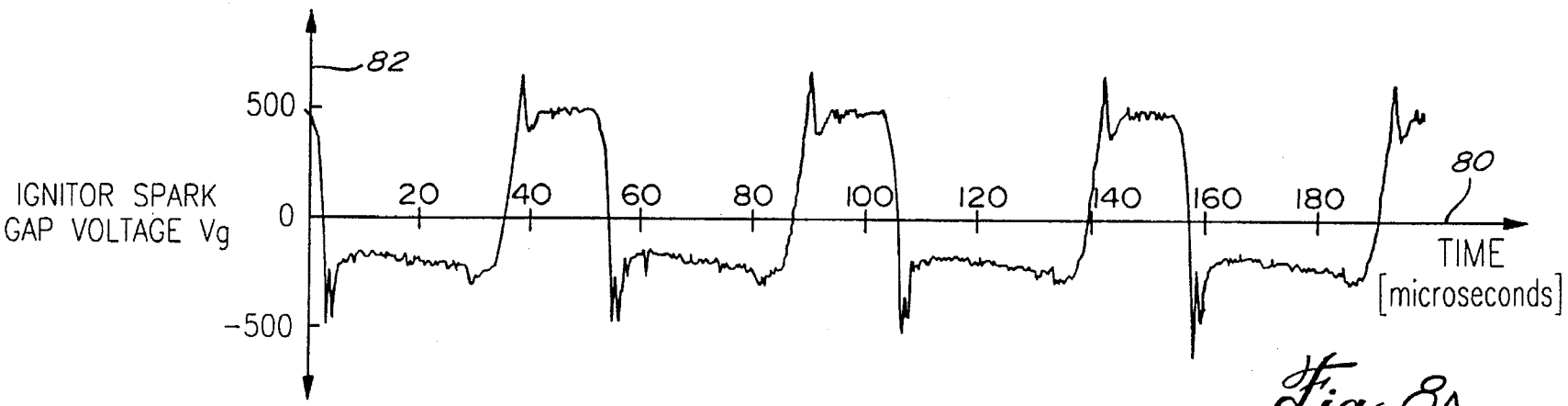
FIGS. 8A and 8B illustrate actual test data plots of ignitor gap voltage $V_g$ and ignitor gap current $I_g$ versus time while a continuous plasma is maintained across the ignitor gap.
Figure 8B:
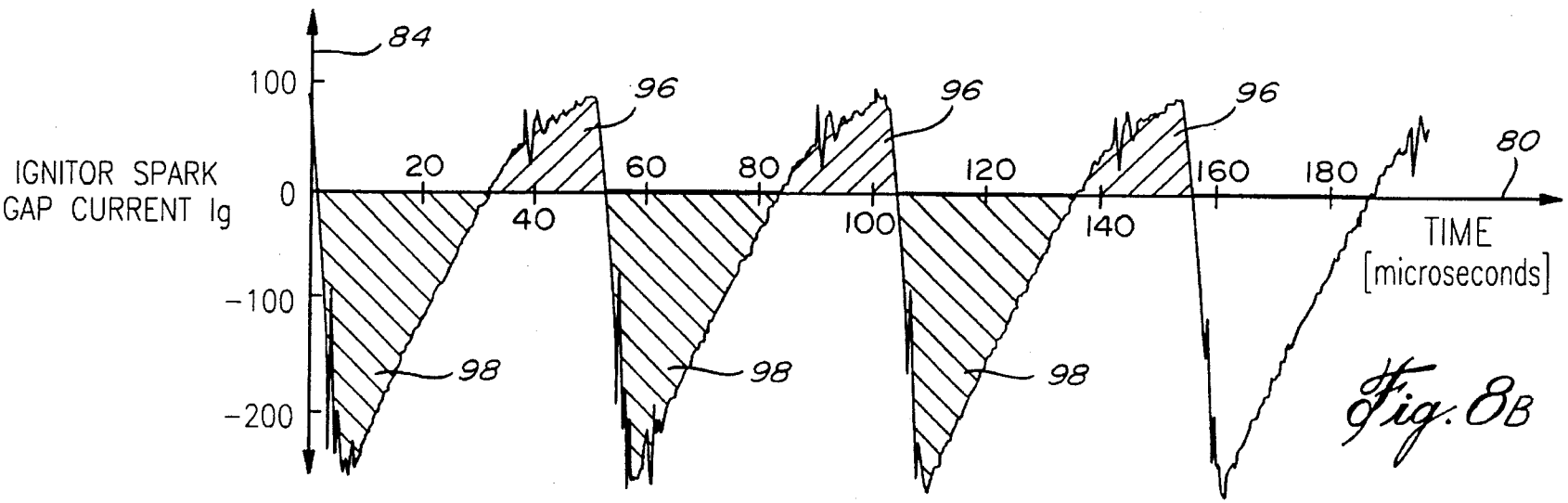

A feature of the present invention is the non-symmetrical nature of the ignitor gap current $I_g$ which creates and sustains the continuous ionized gaseous plasma 23 (FIG. 3). Non-symmetrical refers to the fact the current $I_g$ across the ignitor gap constitutes two components: a positive current and a negative current the sum of which does not equal zero. Referring to FIGS. 8A and 8B, time is plotted along horizontal axes 80, while voltage $V_g$ across the ignitor gap is plotted along a vertical axis 82 in FIG. 8A, and current $I_g$ is plotted along a vertical axis 84 in FIG. 8B. Note, the time scales in FIGS. 8A and 8B are synchronized to facilitate a comparison of both $V_g$ and $I_g$ at the same point in time. Referring to FIG. 8B, positive current is denoted by a cross hatched area 96 above the horizontal axis 80 while the negative current component of $I_g$ is denoted by a second cross hatched area 98 under the horizontal axis 80. Comparing the areas 96 and 98 one can easily see the nonsymmetrical nature of the ignitor gap current $I_g$. In the practice of the present invention, the nonsymmetrical attribute of $I_g$ can be used to control erosion of the outer and inner electrodes 20, 21 respectively.

The net electrical current across the ignitor gap is the difference between the positive and negative current components of $I_g$ over a resonant cycle (i.e., $1/f_r$). By properly selecting the polarity of the net current, the ignitor's operational life may be increased by ensuring electrode erosion occurs primarily on the large outer electrode 20 rather than the small inner electrode 21. Selecting the proper direction for the net current is premised on the fact electrons flow in the direction of electrical current while neutrons and protons flow in the opposite direction of current. Therefore, if the net current flows from the inner electrode to the outer electrode through the plasma 23 (FIG. 3) the mass flow of proton and neutrons will flow from the outer to inner electrode. This ensures the outer electrode 20 wears more than the inner electrode 21 since the outer electrode is supplying the majority of neutrons and protons for the ignitor gap current $I_g$.

It was found during the testing of the present invention that the magnitude of the net current is greatest when the primary winding 38 is set to resonant at three times $f_r$ by properly selecting the value for the capacitor 40. This further helps to ensure electrode erosion occurs primarily on the outer electrode 20.

Attention is drawn to the fact that the resistance across the ignitor gap varies as a function of time. That is, if one compares the voltage $V_g$ and current $I_g$ values in FIGS. 8A and 8B over a period $1/f_r$ seconds, it is apparent the ignitor 16 does not obey Ohms law due to nonlinear voltage $V_g$ versus current $I_g$ relationship (i.e., the current $I_g$ is changing while the voltage $V_g$ remains essentially constant). It is postulated the change in resistance is due to the emission of ultraviolet light created by the high temperature across the electrodes 20, 21. The ultra-violet light causes additional gas to ionize creating more plasma reducing the resistance across the plasma. That is, as plasma current $I_g$ increases more ultra-violet is created providing additional ions which decrease the electrical resistance in the plasma. In general, the plasma is first created across the ignitor gap by placing a high voltage value (e.g., 20 KV) across the electrodes which causes an electrical arc across the electrodes. Plasma flow is created and maintained by stimulating the ionized molecules in the immediate vicinity of the arc which provides charge carriers (i.e., electrons) and hence a lower resistance path for the current $I_g$. The plasma can be maintained by repetitively applying current pulses (the transformer operates as a current transformer once the plasma has formed) at frequency $f_r$ across the electrodes.

Figure 9:
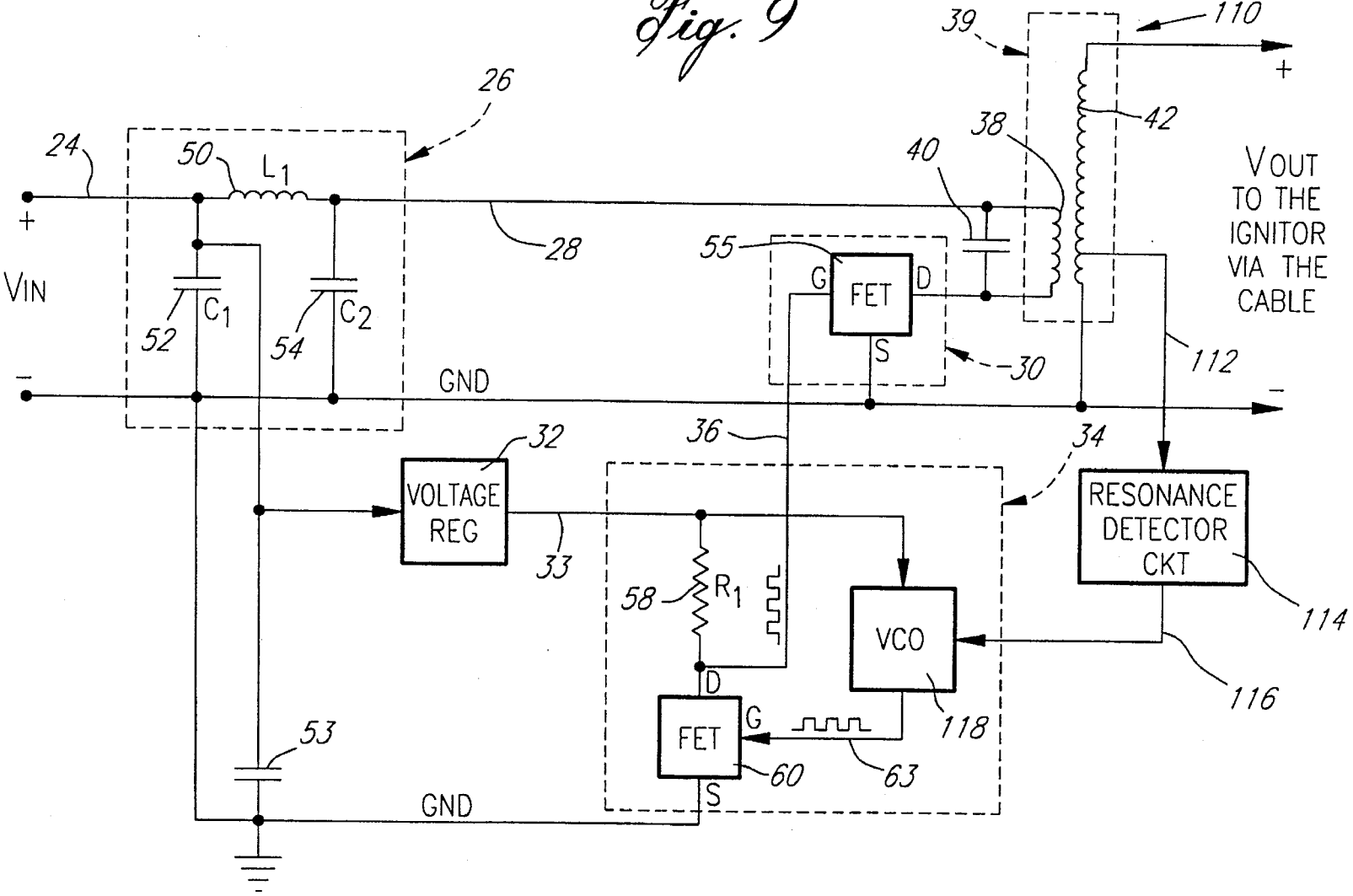
FIG. 9 illustrates a closed loop alternative embodiment of the present invention.

FIG. 9 illustrates an alternative embodiment closed loop resonant ignition system 110 which senses the state of the transformer 39 and drives the system into resonance to create and maintain the continuous plasma. The closed loop embodiment of the present invention operates in essentially the same manner as the open loop embodiment of FIG. 3–4. The two differ primarily in the fact that a feedback sense line 112 is tapped into the secondary winding 42 and input to a resonance detector circuit 114. The detector circuit 114 operates to provide a bias voltage signal on a line 116 having a value which drives the system 110 towards resonant operation. To close the loop, the bias signal value on the line 116 is input to a voltage controlled oscillator (VCO) 118 which provides a periodic signal on the line 63 having a frequency value which is set as a function of the bias signal value. This embodiment has the advantage of allowing wider tolerances for the component parts of the ignition system assuming the closed loop embodiment has the bandwidth to find and lock onto the resonant frequency value of each ignition system and operate at that particular resonant frequency value. Nevertheless, both the closed loop and open loop embodiments work on the same basic premise of exciting the secondary tank circuit at its resonant frequency to create and maintain a continuous plasma across the ignitor gap.

Although several embodiments of the invention have been presented, one of ordinary skill in the art will quickly recognize various changes may be made to the embodiments presented herein while still achieving the continuous plasma of the present invention through resonant circuit operation. As an example, rather than inputting 28 VDC to the exciter any voltage value (having sufficient current) maybe input and the proper signal conditioning circuit added to properly condition/buffer the input voltage signal to the required value. In addition, the RF filter 26 may be removed from the design since the filter is primarily used to prevent electronic switching noise created by the transformer from exiting the exciter and degrading other electronic devices connected to the power bus. Furthermore, one of ordinary skill will quickly realize that just like any circuit design, many changes may be made to the design while maintaining the same functional performance for the system. As an example, rather than using an IC for the oscillator 62, one may construct the oscillator from discrete components. In addition, rather than using FET for the switching devices, other devices such as bipolar devices may be used. The present invention is also not limited to the specific transformer embodiment (wire size, turns ratio, etc. . . ) disclosed herein; any transformer capable of operating in conjunction with the drive circuitry to resonantly drive the ignitor is acceptable.

The foregoing changes and variations are merely a few examples of the underlying principle covered by the present invention. That is, according to the present invention, a continuous plasma ignition system includes an exciter which resonantly drives the ignitor plug and the cable that connects the excitor to the ignitor plug, such that, energy resonating within the ignition system creates and maintains a continuously ionized gaseous plasma across the ignitor gap.

Although the present invention has been shown and described with respect to a preferred embodiment thereof, it should be understood by those skilled in the art that various other changes, omissions, and additions may be made to the embodiments disclosed herein, without departing from the spirit and scope of the present invention.

I claim:

1. A gas turbine ignition system, comprising:

an electrical signal generator to generate an electrical AC signal with a frequency $f_r$:

an ignitor circuit excited by signals generated by said generator, said ignitor circuit including an ignitor, said ignitor circuit being a resonant circuit having a resonant frequency $f_r$, such that said ignitor circuit, when excited by said electrical AC signal generated by said generator, generates a plasma of ionized gas and thereafter maintains said plasma of ionized gas when said ignitor circuit continues to be excited with said electrical AC signal.

2. The ignition system of claim 1 wherein said electrical signal generator comprises:

an oscillator circuit which generates a periodic signal of period $f_r$;

a gate, responsive to said periodic signal and an input voltage signal value, for gating said input voltage signal on and off as a function of said periodic signal to provide an AC signal of frequent $f_r$; and a transformer which excites said ignitor circuit with said AC signal by transforming said AC signal to a high voltage AC signal of frequency $f_r$ within said ignitor circuit.

3. The ignition system of claim 2 wherein said ignitor is an air gap ignitor.

4. The ignition system of claim 3 wherein said transformer is a step up transformer having a primary winding across which said AC signal value is applied, and a secondary winding across which said high voltage AC signal value is provided.

5. The ignition system of claim 4 wherein said electrical signal generator further includes a capacitor located electrically in parallel with said primary winding.

6. The ignition system of claim 5 wherein the value of said capacitor is selected such that said primary winding resonates at a frequency value of about three times greater than frequency value $f_r$.

7. The ignition system of claim 4 wherein, said secondary winding, a set of ignitor cables and said ignitor together are electrically included in said circuit whose resonant frequency is $f_r$.

8. An ignition system, comprising:

an exciter, having an oscillator which generates a periodic signal value of frequency $f_r$ electrically connected to a power switching device which gates a DC voltage signal value on and off at frequency $f_r$ to provide an AC voltage signal of frequency $f_r$ across a primary winding of a step-up transformer that provides a high voltage AC signal value across a secondary winding; and an ignitor circuit being a resonant circuit having a resonant frequency $f_r$ including:

(a) an ignitor which generates a plasma of ionized gas and thereafter maintains said plasma of ionized gas when excited with a signal indicative of said high voltage AC signal. value; and (b) an electrically conductive cable for providing said high voltage AC signal value to said ignitor; and (c) said secondary winding of said transformer.

9. The ignition system of claim 8, wherein said exciter includes a capacitive coupling element connected electrically in parallel with said primary winding, and having a capacitance value selected such that said primary winding electrically resonates at a frequency value about three times $f_r$.

10. The ignition system of claim 8 wherein said ignitor is an air gap ignitor.

11. The ignition system of claim 10 wherein said power switching device is a FET.

12. The ignition system of claim 10 wherein said oscillator includes a voltage controlled oscillator.

13. The ignition system of claim 12 further comprising means for detecting if the resonant circuit is resonating, and for providing a feedback signal value to said voltage controlled oscillator which generates a periodic signal whose value varies as a function of said feedback signal value, the value of said feedback signal is set to drive said resonant circuit towards resonant operation.

14. An ignition system comprising:

an exciter circuit powered by an input voltage signal, including, a voltage regulator responsive to said input voltage signal value for providing a regulated voltage signal value, means responsive to said regulated voltage signal value for generating a periodic signal value, and means for gating said input signal value on and off as a function of said periodic signal value and for providing an AC voltage signal of resonant frequency value $f_r$;

a step-up transformer having a primary winding and a secondary winding, wherein said AC voltage signal value is applied across said primary winding to provide a high voltage AC signal value across said secondary winding; and an ignitor circuit comprising an ignitor connected to said secondary winding by an electrically conductive cable, said ignitor circuit being a resonant circuit having a resonant frequency $f_r$, wherein said ignitor causes said ignitor to generate a plasma of ionized gas and thereafter maintain said plasma of ionized gas when excited with said high voltage AC signal value.

15. The ignition system of claim 14, wherein said means for gating includes a power switching FET.

16. The ignition system of claim 15 wherein said ignitor is an air gap ignitor.

17. The ignition system of claim 16 wherein said exciter circuit further comprises an electrical filter for attenuating electrical noise created by the switching electrical current in said step-up transformer.

18. A gas turbine ignition system, comprising;

an air gap ignitor which continuously generates a plasma of ionized gas when excited with a periodic electrical signal operating at a resonant frequency value $f_r$;

means for generating said periodic electrical signal comprising;

(a) an oscillator circuit which generates a periodic signal of period $f_r$, and (b) means responsive to said periodic signal and an input voltage signal value, for gating said input voltage signal value on and off as a function of said periodic signal to provide an AC signal value, and (c) means for transforming said AC signal value to a high voltage AC signal value and for providing said periodic electrical signal as indicative of said high voltage AC signal value, said means for transforming comprising a step-up transformer having a primary winding across which said AC signal value is applied and a secondary winding across which said high voltage AC single value is provided, and (d) a capacitor located electrically in parallel with said primary winding; and means for providing said periodic electrical signal to said ignitor.

19. The ignition system of claim 18 wherein the value of said capacitor is selected such that said primary winding resonates at a frequency value of about three times greater than frequency value $f_r$.

20. The ignition system of claim 19 wherein, said secondary winding, said means for coupling and said ignitor together electrically form a resonant circuit whose resonance frequency is $f_r$.

21. An ignition system, comprising:

an exciter, said exciter comprising an oscillator which generates a periodic signal value of frequency $f_4$ electrically connected to a power switching device which gates a DC voltage signal value on and off at frequency $f_r$ to provide an AC voltage signal of frequency $f_r$ across a primary winding of a step up transformer that provides a high voltage AC signal value across a secondary winding, said exciter further comprising a capacitive coupling element connected electrically in parallel with said primary winding, said capacitive coupling element having a capacitance value selected such that said primary winding electrically resonates at a frequency value about three times $f_r$;

an ignitor which continuously generates a plasma of ionized gas when excited with a signal indicative of said high voltage AC signal value; and an electrically conductive cable for providing said high voltage AC signal value to said ignitor, such that said primary winding said electrically conductive cable and said ignitor together form a resonant circuit having a resonant frequency value $f_r$.

22. The ignition system of claim 21 wherein said ignitor is an air gap ignitor.

23. The ignition system of claim 22 wherein said power switching device is a FET.

24. The ignition system of claim 22 wherein said oscillator includes a voltage controlled oscillator.

25. The ignition system of claim 24 further comprising means for detecting if the resonant circuit is resonating, and for providing a feedback signal value to said voltage controlled oscillator which generates a periodic signal whose value varies as a function of said feedback signal value, the value of said feedback signal is set to drive said resonant circuit towards resonant operation.

* * * * *

UNITED STATES PATENT AND TRADEMARK OFFICE

CERTIFICATE OF CORRECTION

PATENT NO. : 5,587,630
DATED : Dec. 24, 1996
INVENTOR(S) : Kevin A. Dooley

It is certified that error appears in the above-indentified patent and that said Letters Patent is hereby corrected as shown below:

claim 2, column 8, line 12, delete "frequent" and insert --frequency-- claim 8, column 8, line 49, delete "."

claim 21, column 10, line 18, delete "$f_4$" and insert --$f_r$--

Signed and Sealed this

Nineteenth Day of August, 1997

*Attest:*

Bruce Lehman

BRUCE LEHMAN

*Attesting Officer*

*Commissioner of Patents and Trademarks*